United States Patent [19]

Colby

[11] Patent Number: 4,986,466

[45] Date of Patent: Jan. 22, 1991

[54] BOX AND BLANK FOR FORMING SAME

[75] Inventor: Donald S. Colby, Elk Grove, Ill.

[73] Assignee: Continental Can Company, Inc., Norwalk, Conn.

[21] Appl. No.: 159,314

[22] Filed: Feb. 12, 1988

[51] Int. Cl.[5] ..... B65D 5/20

[52] U.S. Cl. ..... 229/193; 229/132; 229/919

[58] Field of Search ..... 229/126, 132, 169, 170, 229/190, 193, 16 R, 16 A, 6 R, 136, 155, 919, DIG. 11

[56] References Cited

U.S. PATENT DOCUMENTS

| | | | |
|---|---|---|---|
| 230,452 | 7/1880 | Watkins | 229/193 |
| 1,093,705 | 4/1914 | Labombarde | 229/16 A |
| 1,479,416 | 1/1924 | Labombarde | 229/16 A |
| 2,342,543 | 2/1944 | Inman | 229/16 A |
| 2,373,701 | 4/1945 | Meredith | 229/16 A |
| 2,374,458 | 4/1945 | Siewert | 229/16 A |
| 4,059,220 | 11/1977 | Lorenz | 229/126 |
| 4,154,388 | 5/1979 | Hall | 229/193 |

FOREIGN PATENT DOCUMENTS

| | | | |
|---|---|---|---|
| 463204 | 2/1950 | Canada | 229/16 A |
| 1185744 | 8/1959 | France | 229/16 A |
| 4504 | 9/1915 | United Kingdom | 229/16 A |
| 550665 | 1/1943 | United Kingdom | 229/16 A |

*Primary Examiner*—Gary E. Elkins

*Attorney, Agent, or Firm*—Charles E. Brown; Paul Shapiro; Charles A. Brown

[57] ABSTRACT

A box of the wrap around type for bottles and like products. The box is readily formed from a substantially rectangular blank while maintaining a bottom panel thereof in a flat state and folding front and rear panels upwardly with the front and rear panels carrying end forming panels which, when joined together, complete the box. The bottom panel will also have at opposite ends thereof end forming panels which either may be full height and tucked between the end forming panels carried by the front or rear panels, or in the form of glue flaps which will be disposed externally of the end forming panels carried by the front and rear panels.

3 Claims, 3 Drawing Sheets

BOX AND BLANK FOR FORMING SAME

This invention relates in general to new and useful improvements in boxes, and more particularly to a box that is readily erectable from a flat blank and which box has the opposite ends thereof defined by a plurality of end forming panels which are disposed in overlapping relation in the final box.

One feature of the invention is the formation of a box which may be readily formed from a substantially rectangular blank which is formed of foldable boxboard and wherein each end of the box is formed from three layers of end forming panels.

Another feature of the invention is to provide a box from a substantially rectangular blank wherein there is a minimum of waste.

Another feature of the invention is to provide a box of the wrap around type wherein bottles and the like may be seated on a bottom panel and thereafter the box is folded upwardly from the flat blank to form a carton surrounding the bottle or the like.

With the above and other objects in view that will hereinafter appear, the nature of the invention will be more clearly understood by reference to the following detailed description, the appended claims, and the several views illustrated in the accompanying drawings.

Figure 6:
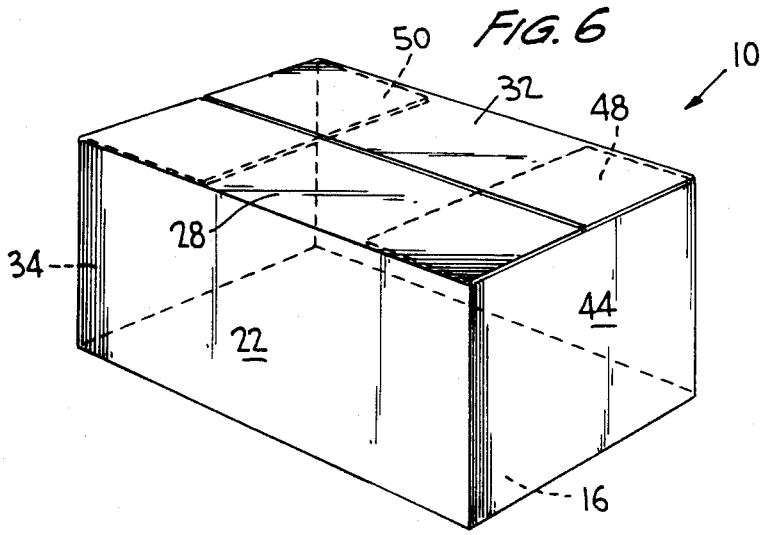
FIG. 6 is a top perspective view showing the box in its closed state.

Referring now to the drawings in detail, reference is first made to FIG. 6 wherein there is illustrated a completed and closed box formed in accordance with this invention, the box being generally identified by the numeral 10. The box 10 is formed from a generally rectangular blank, generally identified by the numeral 12 and best illustrated in FIG. 1. The blank 12 will be described first.

Figure 1:
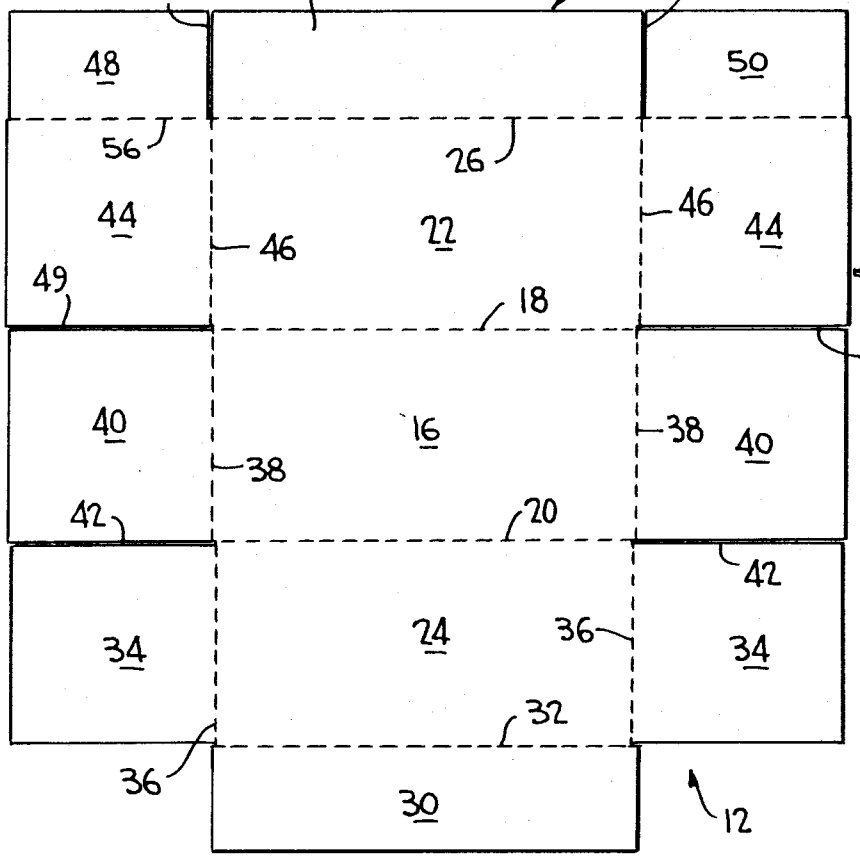
FIG. 1 is a plan view of a blank for forming a preferred box in accordance with this invention.

The blank 12 is generally rectangular in outline, as is shown in FIG. 1, and is formed from a bendable grade of boxboard. The blank 12 is divided into a central portion, generally identified by the numeral 14 by longitudinal fold lines. Most specifically, the longitudinally extending central portion 14 includes a centrally located bottom panel 16. The bottom panel 16 has joined to opposite ends thereof along transverse fold lines 18, 20 a front wall 22 and a rear wall 24. The front wall 22 carries along a transverse fold line 26 a longitudinal closure flap 28. A similar closure flap 30 is carried by the adjacent edge of the rear panel 24 along a transverse fold line 32.

The rear panel 24 has integrally formed with the opposite ends thereof end forming panels 34 which are connected to the rear panel 24 along longitudinal fold lines 36.

In the embodiment shown in FIG. 1, the bottom panel 16 has formed at opposite ends thereof along fold lines 38 end forming panels 40. The end forming panels 40 are separated from the end forming panels 34 by way of transverse cut lines 42 which form at opposite ends of the fold line 20 extensions thereof.

The front panel 22 has formed at opposite ends thereof end forming panels 44 which are connected to the front panel 22 along longitudinal fold lines 46. The end forming panels 44 are separated from the end forming panels 40 by cut lines 49.

Finally, there are transverse closure flaps 48, 50 which are disposed at opposite ends of the longitudinal closure flap 28 and are separated therefrom by longitudinal cut lines 52, 54, respectively. The transverse closure flaps 48, 50 are connected to respective ones of the end forming panels 44 along transverse fold lines 56 which form extensions of the transverse fold line 26 and hingedly connect the transverse closure panels 48, 50 to respective ones of the end forming panels 44, 46.

At this time it is pointed out that articles to be packed within the box 10 may either be seated on the bottom panel 16 and the box folded therearound, or the box, after erection, may have articles seated therein for storage and shipment.

Figure 2:
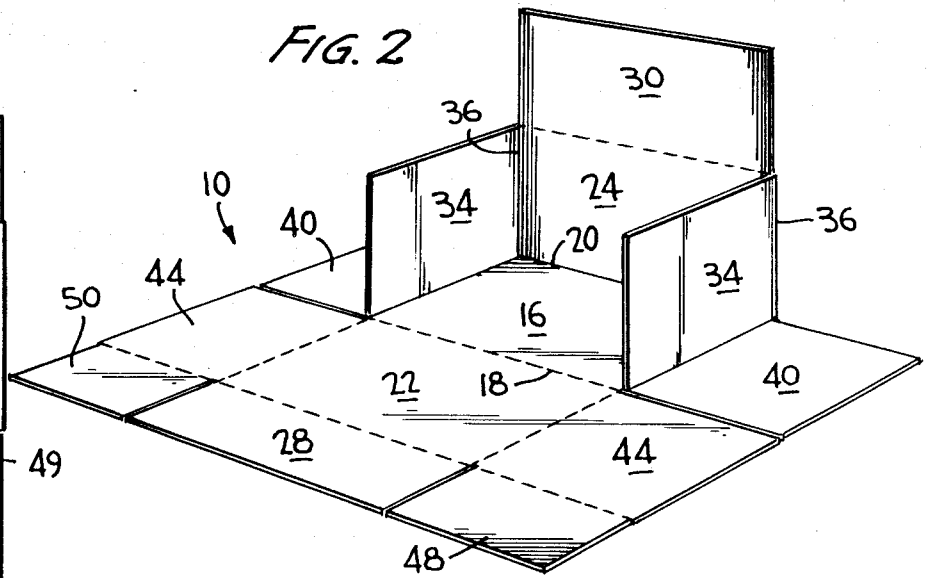
FIG. 2 is a perspective view showing the blank after an initial box forming stage has been effected.

Referring now to FIG. 2, it will be seen that the first step in erecting the blank 12 to form the box 10 is to fold the rear panel 24 upwardly along the fold line 20 relative to the bottom panel 16. Then, or at the same time, the end forming panels 34 are folded forwardly relative to the rear panel 24 along the fold lines 36.

Figure 3:
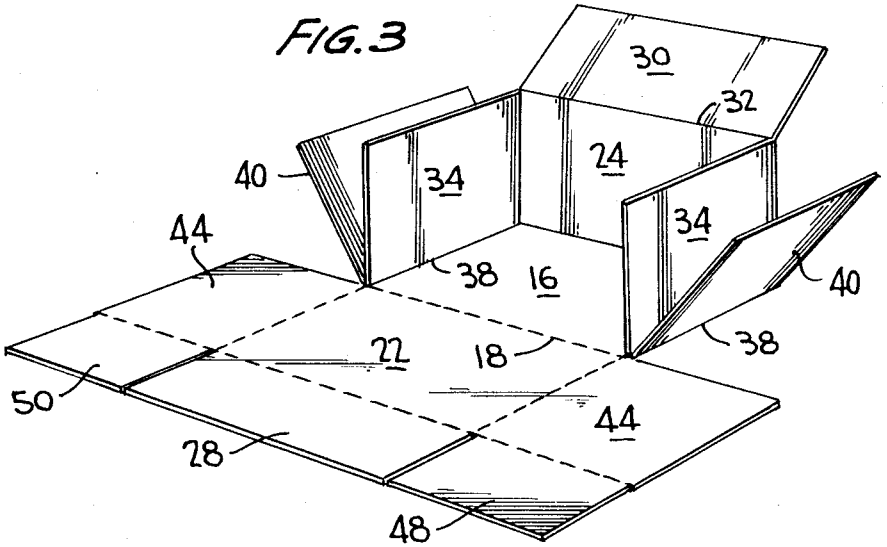
FIG. 3 is another perspective view showing the partially formed box after end forming panels at opposite ends of a bottom panel have been folded upwardly.

Next, as is best shown in FIG. 3, the end forming panels 40 are folded upwardly relative to the bottom panel 16 along longitudinal fold lines 38 until they abut the end forming panels 34. At the same time, the closure flap 30 may be folded slightly outwardly along the transverse fold line 32.

Figure 4:
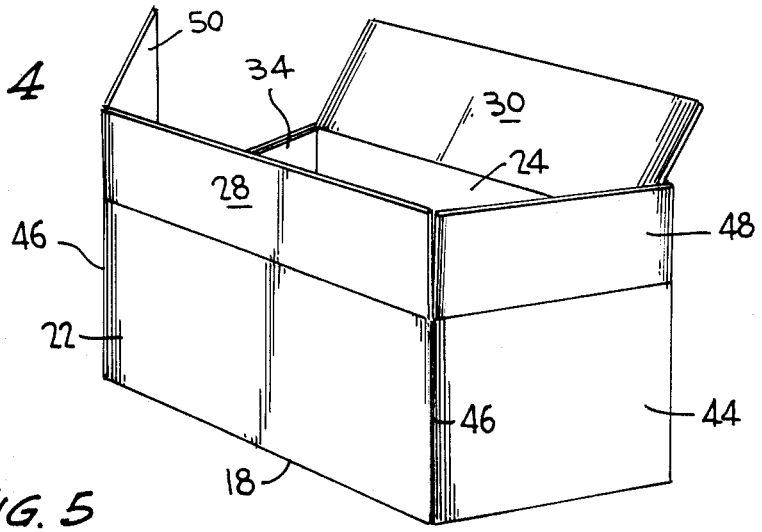
FIG. 4 is another perspective view showing the front panel and end forming panels carried at opposite ends of the front panel after they have been folded upwardly.
Figure 5:
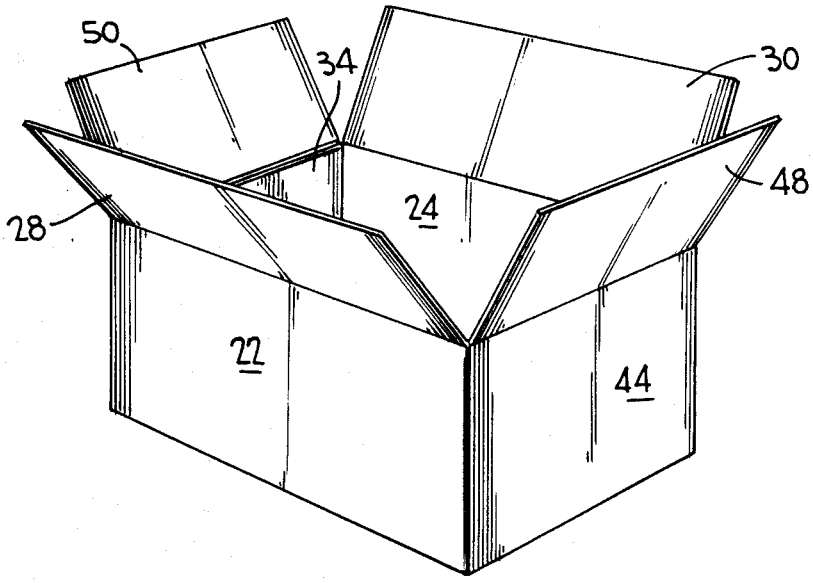
FIG. 5 is a top perspective view of the opened completed box.

Next, with reference to FIG. 4, the front panel 22 is folded upwardly relative to the bottom panel 16 along the transverse fold line 18. Also, the end forming panels 44 are folded rearwardly along the then upstanding fold lines 46 until the end forming panels 44 generally abut the end forming panels 40 and clamp the end forming panels 40 between the end forming panels 44 and the end forming panels 34. These end forming panels, at each end of the box, are then suitably secured together such as by way of an adhesive or even stapling. The closure flaps 28, 48 and 50 are preferably folded outwardly as is shown in FIG. 5.

After the product to be boxed has been placed in the open box, the box 10 is closed by first inwardly folding the transverse closure flaps 48, 50 and thereafter inwardly folding the longitudinal closure flaps 32, 28.

If desired, the closure flaps 28, 32 may be suitably secured to the closure flaps 48, 50.

Figure 8:
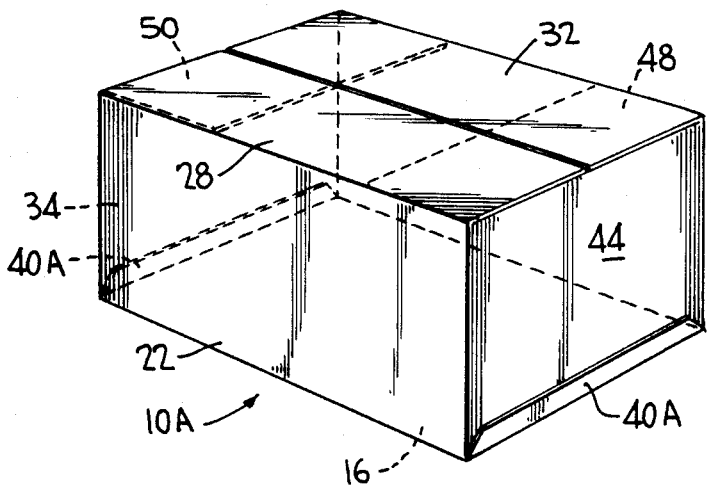
FIG. 8 is a perspective view showing the completed and closed box utilizing the modified form of blank of FIG. 7.

Reference is now made to FIG. 8 wherein there is illustrated a modified form of the box, the box being generally identified by the numeral 10A. The box 10A differs from the box 10 only in that in lieu of providing at opposite ends of the bottom panel 22 full height end forming panels, such as the panels 40, there are provided at opposite ends of the bottom panel 22 glue flaps 40A which are foldably connected to the bottom panel 22 along the previously described longitudinal fold lines 38. Further, instead of the glue flaps 40A being folded upwardly between the end forming panels 34 and 44, the glue flaps 40A are folded upwardly last and are glued to the exterior of the end forming panels 44.

Figure 7:
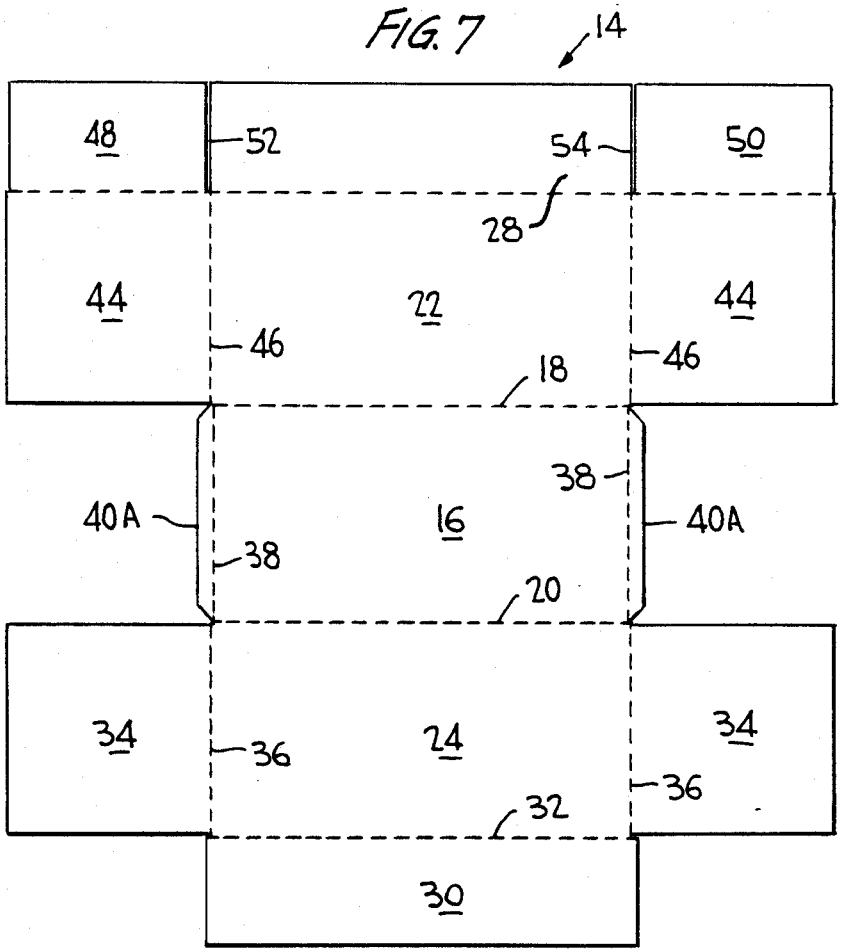
FIG. 7 is a plan view of another form of blank for forming a modified form of box in accordance with this invention.

The modified blank of FIG. 7, which is generally identified by the numeral 12A, has the sole difference in construction over that of the blank 12 in the form of the relatively narrow glue flaps 40A.

In the formation of the box 10A, other panels of the box may be suitably bonded together in the manner generally described with respect to the box 10.

Although only two preferred forms of boxes and blanks from which they are formed have been specifically illustrated and described herein, it is to be understood that minor variations may be made in the boxes and blanks therefor without departing from the spirit and scope of the invention as defined by the appended claims.

I claim:

1. A box formed from a one-piece blank, said box comprising a bottom wall having front and rear walls hingedly connected to said bottom wall along front and rear edges of said bottom wall, an end forming panel carried at opposite ends of each of said front and rear walls, and a transverse closure flap carried by each of said end forming panels carried by said front wall, each wall of said box being rectangular and each of said flaps and said walls being rectangular, a further panel being carried by each end of said bottom for cooperation with said end forming panels, each further panel being a full height end panel.

2. A box according to claim 1 wherein each further panel is positioned between said end forming panels carried by said front and rear walls.

3. A blank for forming a box, said blank being substantially rectangular and formed of boxboard, said blank comprising a longitudinally extending central portion divided by transverse fold lines into a centrally positioned bottom panel having on opposite sides thereof front and rear panels, opposite ends of each of said bottom, front and rear panels having joined thereto end forming panels, a longitudinal closure flap at each end of said longitudinally extending central portion and joined to a respective one of said front and rear panels along a transverse fold line, and a transverse closure flap joined along transverse fold line to each of said end forming panels carried by said front panel, said transverse closure flaps being positioned at opposite ends of said longitudinal closure flap carried by said front panel, all of said panels and flaps being rectangular in outline, and said end forming panels carried by said bottom panel being full height panels.

* * * * *